US010874911B2

(12) United States Patent
Kamino et al.

(10) Patent No.: US 10,874,911 B2
(45) Date of Patent: Dec. 29, 2020

(54) GOLF BALL

(71) Applicant: SUMITOMO RUBBER INDUSTRIES, LTD., Kobe (JP)

(72) Inventors: Kazuya Kamino, Kobe (JP); Hidetaka Inoue, Kobe (JP); Kuniyasu Horiuchi, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/155,471

(22) Filed: Oct. 9, 2018

(65) Prior Publication Data

US 2019/0126102 A1 May 2, 2019

(30) Foreign Application Priority Data

Oct. 31, 2017 (JP) ..... 2017-210085

(51) Int. Cl.

| | |
|---|---|
| ***A63B 37/12*** | (2006.01) |
| ***A63B 37/00*** | (2006.01) |
| ***A63B 1/00*** | (2006.01) |
| *A63B 37/04* | (2006.01) |
| *A63B 37/06* | (2006.01) |

(52) U.S. Cl.

CPC ..... *A63B 37/0075* (2013.01); *A63B 1/00* (2013.01); *A63B 37/008* (2013.01); *A63B 37/0031* (2013.01); *A63B 37/0039* (2013.01); *A63B 37/0043* (2013.01); *A63B 37/0058* (2013.01); *A63B 37/0062* (2013.01); *A63B 37/0092* (2013.01)

(58) Field of Classification Search

USPC ..... 473/351–378

See application file for complete search history.

(56) References Cited

U.S. PATENT DOCUMENTS

| | | | | |
|---|---|---|---|---|
| 5,397,829 A * | 3/1995 | Morgan | ..... | C08F 214/26 524/463 |
| 5,637,663 A * | 6/1997 | Anolick | ..... | C07C 317/04 526/254 |
| 6,210,295 B1 * | 4/2001 | Yoneyama | ..... | A63B 37/12 473/351 |

(Continued)

FOREIGN PATENT DOCUMENTS

| | | | |
|---|---|---|---|
| JP | 06114125 A | * | 10/1994 |
| JP | 3026171 U | | 7/1996 |

(Continued)

*Primary Examiner* — Alvin A Hunter

(74) *Attorney, Agent, or Firm* — Birch, Stewart, Kolasch & Birch, LLP

(57) ABSTRACT

A golf ball 2 includes a main body 4 and a paint layer 6 positioned outside the main body 4. The main body 4 includes a spherical core 8, a mid layer 10 positioned outside the core 8, and a cover 12 positioned outside the mid layer 10. An outer surface of the paint layer 6 forms a surface of the golf ball 2. A contact angle CAw with respect to water measured on the surface of the golf ball 2 is not less than 70 degrees. The paint layer 6 is preferably formed from a resin composition. A preferable resin composition includes a polyurethane as a base resin and includes a silicone compound and/or a fluorine compound. Another preferable resin composition includes a silicone compound and/or a fluorine compound as a base resin and includes no polyurethane.

13 Claims, 1 Drawing Sheet

(56) References Cited

U.S. PATENT DOCUMENTS

| | | | | |
|---|---|---|---|---|
| 6,251,991 | B1 * | 6/2001 | Takesue | C08L 75/04 473/378 |
| 6,794,027 | B1 * | 9/2004 | Araki | C09D 127/18 427/385.5 |
| 7,312,298 | B2 * | 12/2007 | Rajagopalan | A63B 37/0003 473/374 |
| 8,388,882 | B2 * | 3/2013 | Omura | A63B 37/0003 249/115 |
| 8,979,679 | B2 * | 3/2015 | Lee | A63B 37/0004 473/378 |
| 9,149,685 | B2 * | 10/2015 | Kennedy, III et al. | A63B 37/0003 |

FOREIGN PATENT DOCUMENTS

| | | | | | |
|---|---|---|---|---|---|
| JP | 2001-214131 | A | | 8/2001 | |
| JP | 2013-521870 | A | | 6/2013 | |
| JP | 2015-503400 | A | | 2/2015 | |
| JP | 2018102373 | A | * | 7/2018 | C08G 18/758 |
| WO | WO 2011/112437 | A1 | | 9/2011 | |
| WO | WO 2013/101666 | A1 | | 7/2013 | |

* cited by examiner

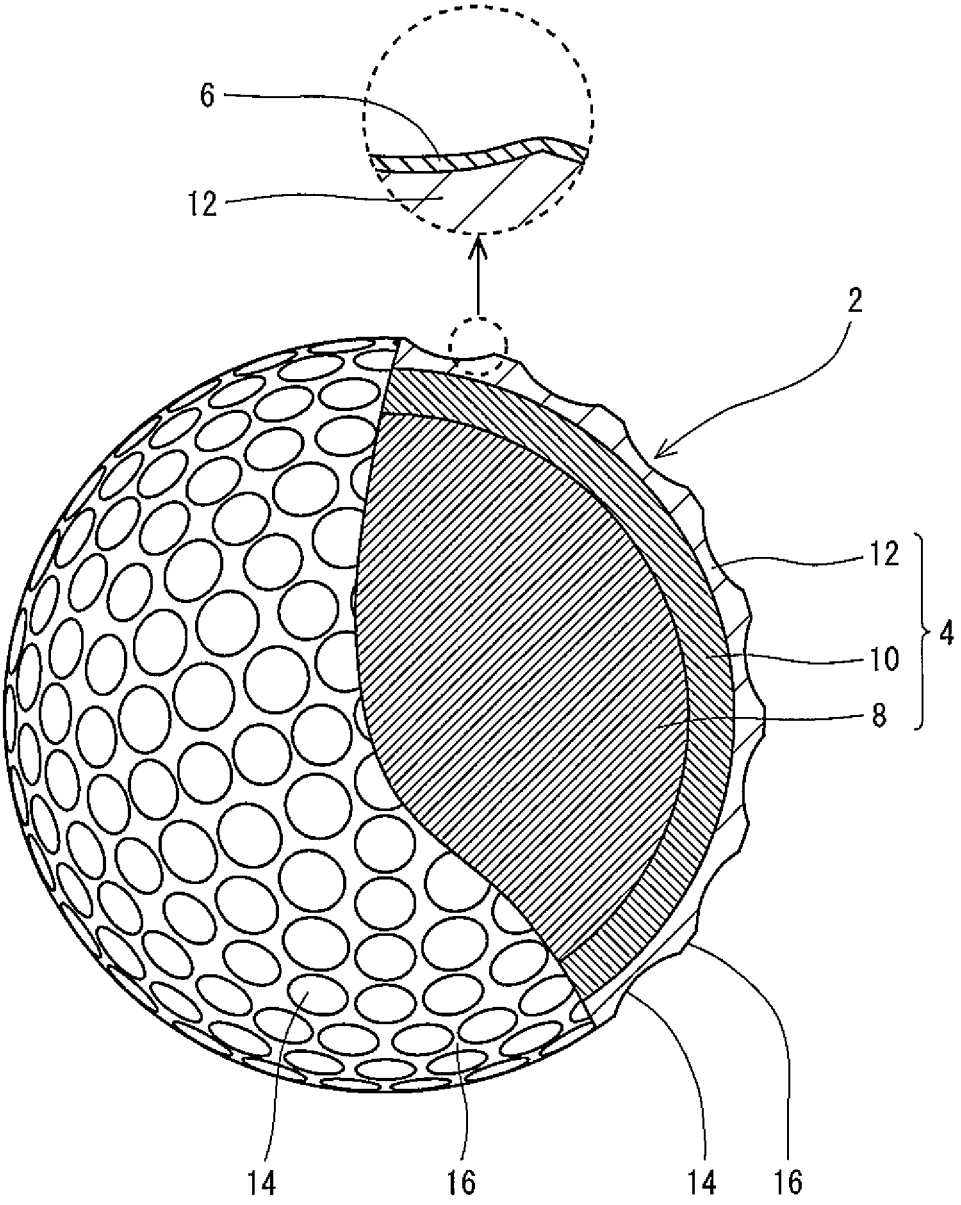
6
12
2
12
4
10
8
14
16
14
16

GOLF BALL

This application claims priority on Patent Application No. 2017-210085 filed in JAPAN on Oct. 31, 2017. The entire contents of this Japanese Patent Application are hereby incorporated by reference.

BACKGROUND OF THE INVENTION

Field of the Invention

The present invention relates to golf balls. Specifically, the present invention relates to golf balls including a paint layer.

Description of the Related Art

The surfaces of most golf balls are coated with paint layers. The main roles of the paint layer in a golf ball are to enhance the appearance of the golf ball and prevent staining of the ball surface. Normally, the paint layer of a golf ball is very thin. The paint layer can contribute to spin performance and feel at impact upon an approach shot upon which a golf ball is hit with weak force.

Golf balls having a paint layer improved in order to improve various performance characteristics have been proposed. JP2015-503400 discloses a golf ball having a surface that is made partially hydrophobic and made partially hydrophilic in order to prevent spin from decreasing under a wet play condition so that controllability is decreased. JP2013-521870 proposes a golf ball having an outer surface to which a protective coating including a hydrophobic thermoplastic polyurethane is applied in order to prevent damage due to moisture absorption. JP2001-214131 discloses a clear paint including an organic silicon compound in order to improve stain resistance.

The greatest interest to golf players concerning golf balls is flight performance. Golf players particularly place importance on flight distances upon shots with drivers. A flight distance upon a shot with a driver correlates with the resilience performance of a golf ball. When a golf ball in which a core having high resilience is used is hit, the golf ball flies at a high speed, and a large flight distance is achieved. An appropriate trajectory height is required in order to achieve a large flight distance. A trajectory height depends on a spin rate and a launch angle. With a golf ball that achieves a high trajectory by a low spin rate and a high launch angle, a large flight distance is achieved.

In play, a golf ball is hit under various conditions. A golf club or a golf ball may get wet with rain or the like. A state where a golf club or a golf ball is wet is referred to as a wet state. On the other hand, a state where a golf club or a golf ball is not wet is referred to as a dry state. In rainy weather or the like, in a wet state where water is present between a clubface and a golf ball, a flight distance upon a shot with a driver may be decreased as compared to that in a dry state. Japanese Utility Model Registration No. 3026171 discloses a golf ball having a surface that is coated with a urethane paint having wear resistance and water repellency such that water droplets are less likely to adhere to the surface.

Golf players desire golf balls that achieve excellent flight performance both in a dry state and in a wet state. However, detailed research regarding factors for a decrease in a flight distance in a wet state has not been conducted yet, and the countermeasures against such a decrease are also not sufficient.

An object of the present invention is to provide a golf ball with which a large flight distance is achieved even upon a shot with a driver in a wet state.

SUMMARY OF THE INVENTION

The present inventors have found that a paint layer can have a great effect even upon a shot with a driver upon which a golf ball is hit with strong force, thereby completing the present invention.

A golf ball according to the present invention includes a main body and a paint layer positioned outside the main body. An outer surface of the paint layer forms a surface of the golf ball. A contact angle CAw with respect to water measured on the surface of the golf ball is not less than 70 degrees.

The golf ball according to the present invention includes the paint layer formed such that the contact angle CAw with respect to water measured on the surface thereof is not less than 70 degrees. When the golf ball is hit with a driver in a wet state, the ball speed is high. When the golf ball flies in a wet state such as in rainy weather, the distance from the highest reaching point of the trajectory to the landing point particularly improves.

With the golf ball, a decrease in a flight distance in rainy weather is inhibited by a high ball speed achieved at impact and improvement of aerodynamic performance during flight. The golf ball has excellent flight performance upon a shot with a driver in a wet state.

The paint layer is preferably formed from a resin composition including a polyurethane as a base resin. The resin composition includes a silicone compound and/or a fluorine compound.

In another aspect, the paint layer is preferably formed from a resin composition including a silicone compound and/or a fluorine compound as a base resin. The resin composition includes no polyurethane.

The contact angle CAw is preferably not less than 75 degrees. The contact angle CAw is preferably not less than 80 degrees.

The contact angle CAw is preferably not greater than 120 degrees. The golf ball preferably has no surface on which the contact angle CAw is less than 70 degrees.

The paint layer preferably has a thickness of not less than 5 μm and not greater than 50 μm.

An indentation depth, measured when the paint layer in a cross-section along a plane passing through a central point of the golf ball is pressed with a force of 30 mgf in a direction perpendicular to the cross-section, is preferably not less than 200 nm and not greater than 3000 nm.

The silicone compound is preferably dimethyl silicone. The fluorine compound is preferably polytetrafluoroethylene.

An amount of the silicone compound and/or the fluorine compound in the resin composition including the polyurethane as the base resin, on the solid content basis, is preferably not less than 0.05% by weight and not greater than 20% by weight.

Preferably, the polyurethane is obtained by mixing a base material and a curing agent, and a mole ratio (NCO group/OH group) of an isocyanate group (NCO group) of the curing agent to a hydroxyl group (OH group) of the base material is not less than 0.1 and not greater than 2.0.

Preferably, the polyurethane is obtained by mixing a base material and a curing agent, and a ratio (A/B) of a weight A of the base material and a weight B of the curing agent is not less than 2/1 and not greater than 20/1.

BRIEF DESCRIPTION OF THE DRAWINGS

FIG. 1 is a partially cutaway cross-sectional view of a golf ball according to one embodiment of the present invention.

DESCRIPTION OF THE PREFERRED EMBODIMENTS

The following will describe in detail the present invention based on preferred embodiments with appropriate reference to the drawings.

A golf ball 2 shown in FIG. 1 includes a main body 4 and a paint layer 6 positioned outside the main body 4. The main body 4 includes a spherical core 8, a mid layer 10 positioned outside the core 8, and a cover 12 positioned outside the mid layer 10. The golf ball 2 has a plurality of dimples 14 on the surface thereof. Of the surface of the golf ball 2, a part other than the dimples 14 is a land 16. The golf ball 2 may include a mark layer between the cover 12 and the paint layer 6.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

As shown, the outermost layer of the golf ball 2 is the paint layer 6. The outer surface of the paint layer 6 forms the surface of the golf ball 2. In the specification of the present application, the "paint layer" is defined as a layer that is formed as the outermost layer of the golf ball 2 and the outer surface of which forms the surface of the golf ball 2.

In the present invention, a contact angle CAw with respect to water is measured on the surface of the golf ball 2 (that is, the outer surface of the paint layer 6). The contact angle CAw with respect to water measured on the surface of the golf ball 2 is not less than 70 degrees. When the golf ball 2 is hit with a driver in a wet state, water droplets are immediately removed from the surface of the golf ball 2. On the golf ball 2, the amount of water present between the face of the driver and the golf ball 2 at impact is small. The ball speed of the golf ball 2 at impact is high.

Furthermore, the golf ball 2 having a surface on which the contact angle CAw with respect to water is not less than 70 degrees is also excellent in aerodynamic performance when flying in a wet state such as in rainy weather in addition to the time of impact. Although the details of the mechanism are presently under consideration, with the golf ball 2, the distance from the highest point of a trajectory to the landing point is particularly improved upon a shot with a driver in a wet state. With the golf ball 2, a decrease in a flight distance in a wet state is inhibited due to improvement of the ball speed at impact and aerodynamic performance during flight. The golf ball 2 has excellent flight performance upon a shot with a driver in a wet state. Furthermore, with the golf ball 2, spin performance and feel at impact upon an approach shot that are originally provided by the paint layer 6 can also be maintained.

In light of flight performance, the contact angle CAw with respect to water measured on the surface of the golf ball 2 is preferably not less than 75 degrees and more preferably not less than 80 degrees. The upper limit of the contact angle CAw is not particularly limited, but the contact angle CAw is preferably not greater than 120 degrees. In light of stability of flight performance, the outer surface of the golf ball 2 preferably includes no surface on which the contact angle CAw is less than 70 degrees.

For measurement of the contact angle, a commercially-available contact angle measuring device is selected as appropriate and used. First, a measuring point is selected at random from the surface of the golf ball 2. Subsequently, the golf ball 2 is placed on a sample table of the contact angle measuring device. At this time, the position of the golf ball 2 is adjusted such that the selected measuring point is horizontal. Next, water is dropped from an injection syringe to the measuring point. After the dropping, an image of a droplet formed on the measuring point is captured, and a contact angle CAw is obtained by the θ/2 method using image analysis software. The contact angle CAw may be measured on the dimple 14 of the golf ball 2 or may be measured on the land 16. In the present application, in consideration of the fact that the areas of the lands 16 of recent golf balls are small and it is difficult to drop water only onto the lands 16, water is dropped onto the dimple 14 upon measurement. The specific measurement conditions will be described later in EXAMPLES.

The thickness and the indentation depth of the paint layer 6 are not particularly limited as long as a surface on which the contact angle CAw is not less than 70 degrees is formed in the surface of the golf ball 2 and the object of the present invention is achieved. In light of ball speed and spin performance upon an approach shot, the thickness of the paint layer 6 is preferably not less than 5 μm and more preferably not less than 6 μm. This thickness is preferably not greater than 50 μm. The indentation depth of the paint layer 6 is preferably not less than 200 nm and more preferably not less than 300 nm. This indentation depth is preferably not greater than 3000 nm. The indentation depth of the paint layer 6 is measured by a method described later in EXAMPLES.

The paint layer 6, which forms the surface of the golf ball 2, is formed from a resin composition. Examples of the base resin of the resin composition include polyurethanes, epoxy resins, acrylic resins, vinyl acetate resins, polyesters, silicone compounds, and fluorine compounds. Examples of particularly preferable resin compositions are the following paint compositions of embodiments.

Embodiment 1: a resin composition in which the principal component of a base resin is a polyurethane and which includes a silicone compound and/or a fluorine compound.

Embodiment 2: a resin composition in which a base resin is a silicone compound and/or a fluorine compound and which includes no polyurethane.

The paint composition of Embodiment 1 is obtained by blending the silicone compound and/or the fluorine compound into a so-called polyurethane paint. Normally, the polyurethane paint is obtained by mixing a polyol composition, which is a base material, and a polyisocyanate composition, which is a curing agent. In other words, the paint composition of Embodiment 1 includes the polyol composition, the polyisocyanate composition, and the silicone compound and/or the fluorine compound. The type of silicone compound is not particularly limited as long as a surface on which the contact angle CAw with respect to water is not less than 70 degrees is formed on the golf ball 2. Examples of preferable silicone compounds include dimethyl silicone, methylphenyl silicone, methyl hydrogen silicone, cyclic silicones, amino-modified silicones, epoxy-modified silicones, carbinol-modified silicones, mercapto-modified silicones, polyether-modified silicones, methylstyryl-modified silicones, alkyl-modified silicones, fluorine-modified silicones, higher fatty acid-modified silicones, methacryl-modified silicones, phenol-modified silicones, and dimethiconol. From the viewpoint that the contact angle CAw with respect to water on the surface of the golf ball 2 is appropriate, a particularly preferable silicone compound is dimethyl silicone. Two or more silicone compounds can be used.

The type of fluorine compound is not particularly limited as long as a surface on which the contact angle CAw with respect to water is not less than 70 degrees is formed on the golf ball 2. Examples of preferable fluorine compounds include polytetrafluoroethylene, polyvinyl fluoride, polyvinylidene fluoride, polychlorotrifluoroethylene, and ethylene-chlorotrifluoroethylene copolymers. From the viewpoint that the contact angle CAw with respect to water on the surface of the golf ball 2 is appropriate, a particularly preferable fluorine compound is polytetrafluoroethylene. Two or more fluorine compounds can be used.

The amount of the silicone compound and/or the fluorine compound is adjusted as appropriate in accordance with the type of selected compound. From the viewpoint that a surface on which the contact angle CAw with respect to water is not less than 70 degrees is obtained on the golf ball 2, the amount of the silicone compound and/or the fluorine compound in the paint composition of Embodiment 1 on the solid content basis is preferably not less than 0.05% by weight and more preferably not less than 0.10% by weight. In light of film formability of the paint layer 6, the amount is preferably not greater than 20% by weight. In the case where the paint composition of Embodiment 1 includes two or more silicone compounds and/or fluorine compounds, the sum of the amounts of the respective compounds is preferably in the above range.

The type and the composition of the polyurethane paint are not particularly limited as long as the advantageous effects of the present invention are not impaired. The polyol composition, which is the base material, and the polyisocyanate composition, which is the curing agent, are selected as appropriate and used such that it is possible to uniformly mix the aforementioned silicone compound and/or the aforementioned fluorine compound and the paint layer 6 is appropriately formed.

The polyol composition, which is the base material, contains a polyol compound. The polyol compound has two or more hydroxyl groups within the molecule thereof. The polyol compound may have a hydroxyl group at an end of the molecule thereof, or may have a hydroxyl group at the portion of the molecule other than the ends thereof. The polyol composition may contain two or more polyol compounds.

The polyol compound having a hydroxyl group at an end of the molecule thereof includes a low-molecular-weight polyol and a high-molecular-weight polyol.

Examples of the low-molecular-weight polyol include: diols such as ethylene glycol, diethylene glycol, triethylene glycol, 1,3-butanediol, 1,4-butanediol, neopentyl glycol, and 1,6-hexanediol; and triols such as glycerin, trimethylol propane, and hexanetriol.

Examples of the high-molecular-weight polyol include: polyether polyols, polyester polyols, polycaprolactone polyols, polycarbonate polyols, urethane polyols, and acrylic polyols. Examples of polyether polyols include polyoxyethylene glycol (PEG), polyoxypropylene glycol (PPG), and polyoxytetramethylene glycol (PTMG). Examples of polyester polyols include polyethylene adipate (PEA), polybutylene adipate (PBA), and polyhexamethylene adipate (PHMA). Examples of polycaprolactone polyols include poly-ε-caprolactone (PCL). Examples of polycarbonate polyols include polyhexamethylene carbonate.

From the viewpoint that the curing time of the polyurethane paint is short, a preferable polyol compound is a urethane polyol. The urethane polyol has two or more urethane bonds and two or more hydroxyl groups. The urethane polyol can be obtained by causing a reaction of a polyol component and a polyisocyanate component under a condition that the hydroxyl groups of the polyol component are excessive with respect to the isocyanate groups of the polyisocyanate component.

Examples of the polyol component, which is a starting material of the urethane polyol, include polyether diols, polyester diols, polycaprolactone diols, and polycarbonate diols. A preferable polyol component is a polyether diol. Examples of the polyether diol include polyoxyethylene glycol, polyoxypropylene glycol, and polyoxytetramethylene glycol. A preferable polyether diol is polyoxytetramethylene glycol.

The polyether diol preferably has a number average molecular weight of not less than 550. The polyether diol having a number average molecular weight of not less than 550 can contribute to spin performance. From this viewpoint, this molecular weight is more preferably not less than 600 and particularly preferably not less than 630. The molecular weight is preferably not greater than 3000. The polyether diol having a molecular weight of not greater than 3000 can contribute to the stain resistance of the paint layer 6. From this viewpoint, the molecular weight is more preferably not greater than 2500 and particularly preferably not greater than 2000. The number average molecular weight of the polyol component is measured by gel permeation chromatography (GPC). The measurement conditions are as follows.

Reference material: polystyrene

Eluant: tetrahydrofuran

Column: organic solvent GPC column ("Shodex KF Series" manufactured by Showa Denko K.K.)

The content of the polyether diol in the urethane polyol is preferably not less than 60% by weight. The urethane polyol the content of which is not less than 60% by weight can contribute to spin performance. From this viewpoint, this content is more preferably not less than 62% by weight and particularly preferably not less than 65% by weight.

A low-molecular-weight polyol can be used as the polyol component, which is the starting material of the urethane polyol. Examples of the low-molecular-weight polyol include: diols such as ethylene glycol, diethylene glycol, triethylene glycol, 1,3-butanediol, 1,4-butanediol, neopentyl glycol, and 1,6-hexanediol; and triols such as glycerin, trimethylol propane, and hexanetriol. Two or more low-molecular-weight polyols may be used as the starting material.

The polyisocyanate component, which is a starting material of the urethane polyol, has two or more isocyanate groups. Examples of the polyisocyanate component include: aromatic polyisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); alicyclic polyisocyanates such as 4,4'-dicyclohexylmethane diisocyanate ($H_6XDI$), hydrogenated xylylene diisocyanate ($H_{12}MDI$), hexamethylene diisocyanate (HDI), isophorone diisocyanate (IPDI), and norbornene diisocyanate (NBDI); and aliphatic diisocyanates. As the starting material, two or more polyisocyanates may be used.

The urethane polyol preferably has a weight average molecular weight of not less than 4000. The urethane polyol having a weight average molecular weight of not less than 4000 can contribute to spin performance. From this viewpoint, the molecular weight is more preferably not less than 4300 and particularly preferably not less than 4500. The molecular weight is preferably not greater than 20000. The urethane polyol having a molecular weight of not greater than 20000 can contribute to the stain resistance of the paint layer 6. From this viewpoint, this molecular weight is more preferably not greater than 18000 and particularly preferably not greater than 16000.

The urethane polyol has a hydroxyl value of preferably not less than 10 mg KOH/g, more preferably not less than 15 mg KOH/g, and particularly preferably not less than 20 mg KOH/g. The hydroxyl value is preferably not greater than 200 mg KOH/g, more preferably not greater than 190 mg KOH/g, and particularly preferably not greater than 180 mg KOH/g. The hydroxyl value is measured according to the standards of "JIS K 1557-1". For the measurement, the acetylation method is adopted.

The polyisocyanate composition, which is the curing agent in the polyurethane paint, contains a polyisocyanate compound. The polyisocyanate compound has two or more isocyanate groups.

Examples of the polyisocyanate compound include: aromatic diisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); alicyclic or aliphatic diisocyanates such as 4,4'-dicyclohexylmethane diisocyanate ($H_{12}MDI$), hydrogenated xylylene diisocyanate ($H_6XDI$), hexamethylene diisocyanate (HDI), isophorone diisocyanate (IPDI), and norbornene diisocyanate (NBDI); and triisocyanates such as an allophanate product, a biuret product, an isocyanurate product, an adduct product of diisocyanates. The polyisocyanate compound may include two or more isocyanates.

Examples of preferable triisocyanates include an isocyanurate product of hexamethylene diisocyanate, a biuret product of hexamethylene diisocyanate, and an isocyanurate product of isophorone diisocyanate.

Preferably, the polyisocyanate composition contains a triisocyanate compound. The proportion of the triisocyanate compound to the entire polyisocyanate in the polyisocyanate composition is preferably not less than 50% by weight, more preferably not less than 60% by weight, and particularly preferably not less than 70% by weight. The polyisocyanate composition may contain only the triisocyanate compound as the polyisocyanate compound.

The isocyanate group amount (NCO %) of the polyisocyanate contained in the polyisocyanate composition is preferably not less than 0.5% by weight, more preferably not less than 1.0% by weight, and particularly preferably not less than 2.0% by weight. The isocyanate group amount is preferably not greater than 45% by weight, more preferably not greater than 40% by weight, and particularly preferably not greater than 35% by weight. The isocyanate group amount (NCO %) is calculated by the following mathematical formula.

$$NCO=(100\times m_i\times 42)/W_i$$

$m_i$: the number of moles of the isocyanate groups in the polyisocyanate

42: the molecular weight of NCO $W_i$: the total weight (g) of the polyisocyanate Specific examples of the polyisocyanate include: trade names "BURNOCK D-800", "BURNOCK DN-950", "BURNOCK DN-955", manufactured by DIC corporation; trade names "Desmodur N 75 MPA/X", "Desmodur N 3300", "Desmodur L 75 (C)", "Desmodur Z 4470", and "Sumidur E21-1", manufactured by Sumika Bayer Urethane CO., Ltd.; trade names "CORONATE HX" and "CORONATE HK", manufactured by Tosoh Corporation; trade names "DURANATE 24A-100", "DURANATE 21S-75E", "DURANATE TPA-100", and "DURANATE TKA-100", manufactured by Asahi Kasei Chemicals Corporation; and trade name "VESTANAT T1890" manufactured by Degussa AG.

The mole ratio (NCO group/OH group) of the isocyanate group (NCO group) of the curing agent to the hydroxyl group (OH group) of the base material of the polyurethane paint in the paint composition of Embodiment 1 is preferably not less than 0.1. The paint layer 6 having excellent stain resistance can be formed from the composition in which the mole ratio (NCO group/OH group) is not less than 0.1. From this viewpoint, the mole ratio is particularly preferably not less than 0.2. The mole ratio is preferably not greater than 2.0. The composition in which the mole ratio is not greater than 2.0 can contribute to spin performance in a wet state. From this viewpoint, the ratio is more preferably not greater than 1.8 and particularly preferably not greater than 1.6.

The ratio (A/B) of the weight A of the base material and the weight B of the curing agent included in the polyurethane paint in the paint composition of Embodiment 1 is preferably not less than 2/1 and more preferably not less than 3/1. The ratio (A/B) is preferably not greater than 20/1.

The paint composition of Embodiment 2 is different from the paint composition of Embodiment 1 in that no polyurethane is included in the paint composition of Embodiment 2. The base resin of the paint composition of Embodiment 2 is a silicone compound and/or a fluorine compound. The type of silicone compound and/or fluorine compound is not particularly limited as long as a surface on which the contact angle CAw with respect to water is not less than 70 degrees is formed on the golf ball 2.

The silicone compound described above for the paint composition of Embodiment 1 can be suitably used as the base resin of the paint composition of Embodiment 2. From the viewpoint that the contact angle CAw with respect to water on the surface of the golf ball 2 is appropriate, a particularly preferable silicone compound is dimethyl silicone. Two or more silicone compounds can be used.

The fluorine compound described above for the paint composition of Embodiment 1 can be suitably used as the base resin of the paint composition of Embodiment 2. From the viewpoint that the contact angle CAw with respect to water on the surface of the golf ball 2 is appropriate, a particularly preferable fluorine compound is polytetrafluoroethylene. Two or more fluorine compounds can be used.

As long as the advantageous effects of the present invention are not impaired, the resin composition of the paint layer 6 may include additives such as an antioxidant, a light stabilizer, a softener, a processing aid, a coloring agent, and the like, and a diluent such as water, an organic solvent, and the like.

In the golf ball 2, the paint layer 6 is formed by applying the resin composition onto the surface of the main body 4. Specifically, the paint layer 6 is formed by applying the resin composition onto the surface of the cover 12. The paint layer 6 may be formed by applying the resin composition in an overlapped manner. In the case of application in an overlapped manner, the resin composition applied earlier and the resin composition applied later may be of the same type or may be of different types. From the viewpoint that a surface on which the contact angle CAw is not less than 70 degrees is easily obtained on the golf ball 2, the aforementioned paint composition of Embodiment 1 or 2 is preferably used as the resin composition applied later.

The golf ball 2 may include one or more inner paint layers between the main body 4 and the paint layer 6, which is the outermost layer. Each inner paint layer is formed by applying a paint composition onto the surface of the main body 4. The type of the paint composition forming each inner paint layer is not particularly limited as long as the advantageous effects of the present invention are not impaired. Each inner paint layer may be formed from the aforementioned paint composition of Embodiment 1 or 2, or may formed from a different type of resin composition from the paint compositions of Embodiment 1 and 2. Typically, the polyurethane paint described above for the paint composition of Embodiment 1 is suitably used.

Hereinafter, a preferable configuration and materials of the core 8, the mid layer 10, and the cover 12, which form the main body 4 included in the golf ball 2, will be sequentially described. However, the main body 4 may further include a layer formed from another material as long as the object of the present invention is achieved. An embodiment in which the main body 4 does not include the mid layer 10 and/or the cover 12 is also included in the technical scope of the present invention.

The core 8 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The rubber composition of the core 8 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 8 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or crosslinked rubber powder.

The core 8 has a weight of preferably not less than 10 g and not greater than 42 g. The temperature for crosslinking the core 8 is not lower than 140° C. and not higher than 180° C. The time for crosslinking the core 8 is not shorter than 10 minutes and not longer than 60 minutes.

The core 8 has a diameter d of preferably not less than 30.0 mm and particularly preferably not less than 38.0 mm. The diameter d of the core 8 is preferably not greater than 42.0 mm and particularly preferably not greater than 41.5 mm. The core 8 may include two or more layers. The core 8 may have a rib on the surface thereof. The core 8 may be hollow.

The core 8 has an amount of compressive deformation Sc of preferably not less than 2.5 mm and more preferably not less than 2.6 mm. The amount of compressive deformation Sc of the core 8 is preferably not greater than 4.2 mm and more preferably not greater than 4.0 mm. The method for measuring the amount of compressive deformation Sc will be described later.

A Shore C hardness Ho at the central point of the core 8 is preferably not less than 40 and more preferably not less than 50. The hardness Ho of the core 8 is preferably not greater than 75 and more preferably not greater than 65. A Shore C hardness Hs at the surface of the core 8 is preferably not less than 60 and more preferably not less than 70. The hardness Hs of the core 8 is preferably not greater than 95 and more preferably not greater than 90. The difference (Hs−Ho) between the hardness Hs and the hardness Ho in the core 8 is preferably not less than 10 and more preferably not less than 15. The difference (Hs−Ho) is preferably not greater than 40 and more preferably not greater than 35.

The hardness Ho is measured by pressing a Shore C type hardness scale mounted to an automated hardness meter (trade name "digi test II" manufactured by Heinrich Bareiss Prufgeratebau GmbH), against the central point of the cross-section of a hemisphere obtained by cutting the core 8. The hardness Hs is measured by pressing this hardness meter against the surface of the core 8. Both measurements are conducted in an environment of 23° C. The mid layer 10 is formed from a resin composition.

A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin or together with an ionomer resin, the resin composition of the mid layer 10 may include another polymer. Examples of the other polymer include polystyrenes, polyamides, polyesters, polyolefins, and polyurethanes. The resin composition may include two or more polymers.

The resin composition of the mid layer 10 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 10 has a Shore D hardness Hm of preferably not less than 40 and particularly preferably not less than 50. The hardness Hm is preferably not greater than 80 and particularly preferably not greater than 70. The method for measuring the Shore D hardness Hm of the mid layer 10 will be described later.

The mid layer 10 has a thickness Tm of preferably not less than 0.2 mm and particularly preferably not less than 0.3 mm. The thickness Tm is preferably not greater than 2.5 mm and particularly preferably not greater than 2.2 mm. The thickness Tm of the mid layer 10 is measured at a position immediately below the land 16.

The mid layer 10 has a specific gravity of preferably not less than 0.90 and particularly preferably not less than 0.95. The specific gravity of the mid layer 10 is preferably not greater than 1.10 and particularly preferably not greater than 1.05. The mid layer 10 may include two or more layers.

The cover 12 is formed from a resin composition. A preferable base polymer of the resin composition is a polyurethane. The resin composition may include a thermoplastic polyurethane or may include a thermosetting polyurethane. In light of productivity, the thermoplastic polyurethane is preferable. The thermoplastic polyurethane includes a polyurethane component as a hard segment, and a polyester component or a polyether component as a soft segment.

The polyurethane has a urethane bond within the molecule. The urethane bond can be formed by reacting a polyol with a polyisocyanate.

The polyol, which is a material for the urethane bond, has a plurality of hydroxyl groups. Low-molecular-weight polyols and high-molecular-weight polyols can be used.

Examples of an isocyanate for the polyurethane component include alicyclic diisocyanates, aromatic diisocyanates, and aliphatic diisocyanates. Alicyclic diisocyanates are particularly preferable. Since an alicyclic diisocyanate does not have any double bond in the main chain, the alicyclic diisocyanate suppresses yellowing of the cover 12. Examples of alicyclic diisocyanates include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI). In light of versatility and processability, $H_{12}$MDI is preferable.

Instead of a polyurethane, the resin composition of the cover 12 may include another polymer. Examples of the other polymer include ionomer resins, polystyrenes, polyamides, polyesters, and polyolefins. The resin composition may include two or more polymers.

The resin composition of the cover 12 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 12 has a hardness Hc of preferably not less than 20, more preferably not less than 22, and particularly preferably not less than 24. The hardness Hc is preferably not greater than 50, more preferably not greater than 48, and particularly preferably not greater than 46.

The hardness Hc of the cover 12 (or the hardness Hm of the mid layer 10) is measured according to the standards of "ASTM-D 2240-68". The hardness is measured with a Shore D type hardness scale mounted to an automated hardness meter (trade name "digi test II" manufactured by Heinrich Bareiss Prufgeratebau GmbH). For the measurement, a sheet that is formed by hot press, is formed from the same material as that of the cover 12 (or the mid layer 10), and has a thickness of about 2 mm is used. Prior to the measurement, a sheet is kept at 23° C. for two weeks. At the time of measurement, three sheets are stacked.

The cover 12 has a thickness Tc of preferably not less than 0.1 mm, more preferably not less than 0.3 mm, and particularly preferably not less than 0.4 mm. The thickness Tc is preferably not greater than 2.0 mm, more preferably not greater than 1.5 mm, and particularly preferably not greater than 1.0 mm. The thickness Tc of the cover 12 is measured at a position immediately below the land 16.

The cover 12 may include two or more layers.

The golf ball 2 may include a reinforcing layer between the mid layer 10 and the cover 12. The reinforcing layer firmly adheres to the mid layer 10 and also to the cover 12. The reinforcing layer suppresses separation of the cover 12 from the mid layer 10. The reinforcing layer is formed from a polymer composition. Examples of the base polymer of the reinforcing layer include two-component curing type epoxy resins and two-component curing type urethane resins.

The golf ball 2 has an amount of compressive deformation Sb of preferably not less than 2.0 mm and more preferably not less than 2.2 mm. The amount of compressive deformation Sb of the golf ball 2 is preferably not greater than 3.8 mm and more preferably not greater than 3.6 mm.

For measurement of an amount of compressive deformation, a YAMADA type compression tester is used. In the tester, a sphere (the core 8 or the golf ball 2) is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is measured as an amount of compressive deformation.

EXAMPLES

The following will show the effects of the present invention by means of Examples, but the present invention should not be construed in a limited manner on the basis of the description of these Examples.

Example 1

A rubber composition was obtained by kneading 100 parts by weight of a high-cis polybutadiene (trade name "BR-730", manufactured by JSR Corporation), 30.5 parts by weight of zinc diacrylate, 10 parts by weight of zinc oxide, an appropriate amount of barium sulfate, 0.1 parts by weight of 2-thionaphthol, 0.3 parts by weight of pentabromo diphenyl disulfide, 0.7 parts by weight of dicumyl peroxide, and 2 parts by weight of benzoic acid. This rubber composition was placed into a mold including upper and lower mold halves each having a hemispherical cavity, and heated at 150° C. for 19 minutes to obtain a core with a diameter d of 39.7 mm. The amount of barium sulfate was adjusted such that a core having a predetermined weight was obtained.

A resin composition was obtained by kneading 55 parts by weight of an ionomer resin (trade name "Himilan AM7329", manufactured by Du Pont-MITSUI POLYCHEMICALS Co., Ltd.), 45 parts by weight of another ionomer resin (trade name "Himilan 1555", manufactured by Du Pont-MITSUI POLYCHEMICALS Co., Ltd.), an appropriate amount of barium sulfate, and 3 parts by weight of titanium dioxide with a twin-screw kneading extruder. The core was covered with this resin composition by injection molding to form a mid layer with a thickness Tm of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 12 hours to obtain a reinforcing layer with a thickness of 10 μm.

A resin composition was obtained by kneading 100 parts by weight of a thermoplastic polyurethane elastomer (trade name "Elastollan NY80A", manufactured by BASF Japan Ltd.), 4 parts by weight of titanium dioxide, and 0.04 parts by weight of ultramarine blue with a twin-screw kneading extruder. Half shells were obtained from this resin composition by compression molding. The sphere consisting of the core, the mid layer, and the reinforcing layer was covered with two of these half shells. These half shells and the sphere were placed into a final mold that includes upper and lower mold halves each having a hemispherical cavity and having a large number of pimples on its cavity face, and a cover was obtained by compression molding. The thickness Tc of the cover was 0.5 mm.

The configuration of a main body (I) consisting of the core, the mid layer, and the cover is shown in Table 1 below.

Polytetramethylene ether glycol (PTMG, number average molecular weight: 650) and trimethylol propane (TMP) were dissolved in a solvent (toluene and methyl ethyl ketone). The mole ratio (PTMG:TMP) was 1.8:1.0. Dibutyltin dilaurate was added to this solution as a catalyst in an amount of 0.1% by weight with respect to the entire base material. While this polyol solution was kept at 80° C., isophorone diisocyanate (IPDI) was dropped and mixed into the polyol solution. The mole ratio (NCO/OH) of this mixture solution was 0.6. After the dropping, the mixture solution was continuously agitated until isocyanate was eliminated. Thereafter, the mixture solution was cooled at normal temperature to obtain a base material A1 that is a urethane polyol composition. The details of the base material A1 are as follows.

Solid content: 30% by weight

Content of PTMG: 67% by weight

Hydroxyl value of solid content: 67.4 mg KOH/g

Weight average molecular weight of urethane polyol: 4867

Mixed were 30 parts by weight of an isocyanurate-modified product of hexamethylene diisocyanate (trade name "DURANATE TKA-100", manufactured by Asahi Kasei Chemicals Corporation, NCO content: 21.7% by weight), 30 parts by weight of a biuret-modified product of hexamethylene diisocyanate (trade name "DURANATE 21S-75E", manufactured by Asahi Kasei Chemicals Corporation, NCO content: 15.5% by weight), and 40 parts by weight of an isocyanurate-modified product of isophorone diisocyanate (trade name "Desmodur Z 4470", manufactured by Sumika Bayer Urethane CO., Ltd., NCO content: 11.9% by weight). A mixed solvent of methyl ethyl ketone, n-butyl acetate, and toluene was added as a solvent to this mixture to obtain a curing agent B1 that is a polyisocyanate composition. The concentration of the polyisocyanate component in the curing agent B1 was 60% by weight.

A paint composition P3 was obtained by mixing the aforementioned base material A1 (urethane polyol composition), the aforementioned curing agent B1 (polyisocyanate composition), and a dimethyl silicone oil (product name "KF-96", manufactured by Shin-Etsu Silicones). The weight ratio (A/B) of the base material A1 and the curing agent B1 on the solid content basis was 3.06/1. The amount of the silicone compound in the composition P3 on the solid content basis was 0.5% by weight. The surface of the aforementioned main body (I) consisting of the core, the mid layer, the reinforcing layer, and the cover was treated with sandblast, and then the paint composition P3 was applied to the surface of the main body (I). In the application, an air gun was used, and the composition P3 was sprayed at a distance of 7 cm from the main body surface. The spraying conditions were two times of application in an overlapped manner, a spraying air pressure of 0.15 MPa, a pressure-feed tank air pressure of 0.10 MPa, an application time of 1 sec for each application, an atmospheric temperature of 20 to 27° C., and an atmospheric humidity of 65% or lower.

The paint composition P3 applied to the main body surface was dried at 40° C. for 24 hours to obtain a golf ball of Example 1 including a paint layer as an outermost layer. The thickness To of the paint layer was 10 μm. The diameter of the golf ball was about 42.7 mm, and the weight of the golf ball was about 45.6 g.

Example 2

A main body (I) consisting of a core, a mid layer, and a cover was produced in the same manner as Example 1. Thereafter, a paint composition P2 was obtained by mixing the aforementioned base material A1 and the aforementioned curing agent B1. The weight ratio (A/B) of the base material A1 and the curing agent B1 on the solid content basis was 3.06/1. The surface of the main body (I) was treated with sandblast, and then the paint composition P2 was applied to the surface of the main body (I) and dried at 40° C. for 24 hours to form an inner paint layer. The thickness Ti of the inner paint layer was 10 μm.

Next, a silicone coating agent (trade name "Mist Glaco", manufactured by SOFT99 corporation) was prepared as a paint composition P4. The composition P4 was applied to the surface of the inner paint layer and dried at 40° C. for 24 hours to obtain a golf ball of Example 2 including a paint layer as an outermost layer. The thickness To of the paint layer was 5 μm.

Example 3

A main body (I) consisting of a core, a mid layer, and a cover was produced in the same manner as Example 1. In the same manner as Example 2, the paint composition P2 was applied to the surface of the main body (I) and dried at 40° C. for 24 hours to form an inner paint layer. Next, a fluorine coating agent (trade name "Mirror Shine", manufactured by SOFT99 corporation) was prepared as a paint composition P5. The composition P5 was applied to the surface of the inner paint layer and dried at 40° C. for 24 hours to obtain a golf ball of Example 3 including a paint layer as an outermost layer. The thickness To of the paint layer was 5 μm.

Examples 4 to 7 and Comparative Examples 1 and 2

Golf balls of Examples 4 to 7 and Comparative Examples 1 and 2 were obtained in the same manner as Example 2, except the configuration of the paint layer, which is the outermost layer, was as shown in Tables 4 and 5. The used paint composition is shown in detail in Tables 2 and 3 below.

[Contact Angle Measurement]

A golf ball was placed on a sample table of a contact angle measuring device (DropMaster DM501) manufactured by Kyowa Interface Science Co., Ltd., and the position of the ball was adjusted such that the bottom surface of a dimple selected at random was horizontal. Thereafter, 2 μl of pure water was dropped onto the bottom surface of the dimple using an injection syringe (22G, manufactured by Kyowa Interface Science Co., Ltd.). After 30 seconds from the dropping, an image of the droplet was captured, and the water contact angle CAw was measured by the θ/2 method. In this measurement method, when the ball had dimples having different diameters, a selection was made from among dimples having the maximum diameter. For one ball, the average of measurement values obtained for three measuring points extracted at random is shown in Tables 4 and 5 below.

[Measurement of Indentation Depth]

A golf ball was divided along a cross-section passing through the central point of the golf ball, and the cross-section of the golf ball is processed so as to be horizontal by a cryo-microtome. A penetrator of a nanoindenter ("ENT-2100", manufactured by ELIONIX INC.) was brought into contact with the paint layer portion of the cross-section, and a load was applied to the penetrator in a direction perpendicular to the cross-section. When the load was 30 mgf, the advancing distance of the penetrator was measured as an indentation depth. The conditions at the time of measurement are as follows. The obtained indentation depth is shown in Tables 4 and 5 below.

Temperature: 30° C.

Penetrator: a Berkovich penetrator (65.03° As (h)=26.43 $h^2$)

Number of partitions: 500 steps

Step interval: 20 msec (100 mgf)

[Flight Performance 1—Dry]

A driver (trade name "Z765", manufactured by DUNLOP SPORTS CO. LTD., shaft hardness: S, loft angle: 9.5°) was attached to a swing machine manufactured by Golf Laboratories, Inc. A golf ball was hit under a condition of a head speed of 50 m/s, and the ball speed Vd (m/s) immediately after the hit in a dry state was measured. Furthermore, the distance FTd (m) from the launch point to the landing point and the distance FRd (m) from the highest reaching point to the landing point were measured. At the time of measurement, the weather was almost windless. The average value of eight measurement results is shown in Tables 4 and 5 below.

[Flight Performance 2—Wet]

The same test was performed in a state where water was adhered to the face of the driver and a golf ball, whereby the ball speed Vw (m/s) immediately after the hit in a wet state, the distance FTw (m) from the launch point to the landing point, and the distance FRw (m) from the highest reaching point to the landing point were measured. At the time of measurement, the weather was almost windless. The average value of eight measurement results is shown in Tables 4 and 5 below.

TABLE 1

| Configuration of Main Body | |
|---|---|
| | (I) |
| Core | |
| Diameter d (mm) | 39.7 |
| Sc (mm) | 3.3 |
| Ho (shore C) | 53 |
| Hs (shore C) | 80 |
| Hs − Ho | 27 |
| Mid layer | |
| Hm (shore D) | 62 |
| Thickness (mm) | 1.0 |
| Cover | |
| Hc (shore D) | 27 |
| Tc (mm) | 0.5 |

TABLE 2

| Paint Composition | | | | |
|---|---|---|---|---|
| | P1 | P2 | P3 | P4 |
| Base material A1 (phr) | 100 | 100 | 100 | 0 |
| Curing agent B1 (phr) | 7.4 | 16.3 | 16.3 | 0 |
| Silicone compound A (wt. %) | 0 | 0 | 0.5 | 0 |
| Silicone compound B (wt. %) | 0 | 0 | 0 | 100 |
| Fluorine compound (wt. %) | 0 | 0 | 0 | 0 |
| Ratio (A/B) (by wt.) | 6.8/1 | 3.06/1 | 3.06/1 | — |
| Ratio (NCO/OH) (by mole) | 0.46 | 1.03 | 1.03 | — |

TABLE 3

| Paint Composition | | | |
|---|---|---|---|
| | P5 | P6 | P7 |
| Base material A1 (phr) | 0 | 100 | 100 |
| Curing agent B1 (phr) | 0 | 7.4 | 16.3 |
| Silicone compound A (wt. %) | 0 | 0.5 | 0 |
| Silicone compound B (wt. %) | 0 | 0 | 0.5 |
| Fluorine compound (wt. %) | 100 | 0 | 0 |
| Ratio (A/B) (by wt.) | — | 6.8/1 | 3.06/1 |
| Ratio (NCO/OH) (by mole) | — | 0.46 | 1.03 |

The details of the compounds listed in Tables 2 and 3 are as follows.

Silicone compound A: a dimethyl silicone oil, product name "KF-96", manufactured by Shin-Etsu Silicones Silicone compound B: a silicone coating agent, trade name "Mist Glaco", manufactured by SOFT99 corporation Fluorine compound: a fluorine coating agent, trade name "Mirror Shine", manufactured by SOFT99 corporation

TABLE 4

| Results of Evaluation | Ex. 1 | Ex. 2 | Ex. 3 | Comp. Ex. 1 | Comp. Ex. 2 |
|---|---|---|---|---|---|
| Inner paint layer | | | | | |
| Composition | — | 2 | 2 | 2 | 2 |
| Thickness (μm) | — | 10 | 10 | 10 | 10 |
| Paint layer (outermost layer) | | | | | |
| Composition | P3 | P4 | P5 | P1 | P2 |
| Indentation depth (nm) | — | — | — | 1500 | 390 |
| Thickness (μm) | 10 | 5 | 5 | 10 | 10 |
| CAw (degrees) | 72 | 82 | 77 | 62 | 68 |
| Sb (mm) | 2.8 | 2.8 | 2.8 | 2.8 | 2.8 |
| W#1 flight performance | | | | | |
| Vd (m/s) | 73.0 | 73.0 | 73.0 | 73.0 | 73.0 |
| Vw (m/s) | 72.6 | 73.0 | 72.8 | 72.1 | 72.3 |
| FTd (m) | 247 | 247 | 247 | 247 | 247 |
| FTw (m) | 229 | 235 | 232 | 220 | 225 |
| FRd (m) | 84 | 84 | 84 | 84 | 84 |
| FRw (m) | 75 | 78.5 | 77 | 70 | 73 |
| Vd − Vw (m/s) | 0.4 | 0 | 0.2 | 0.9 | 0.7 |
| FTd − FTw (m) | 18 | 12 | 15 | 27 | 22 |
| FRd − FRw (m) | 9 | 5.5 | 7 | 14 | 11 |

TABLE 5

| Results of Evaluation | Ex. 4 | Ex. 5 | Ex. 6 | Ex. 7 |
|---|---|---|---|---|
| Inner paint layer | | | | |
| Composition | 2 | 2 | 2 | 2 |
| Thickness (μm) | 10 | 10 | 10 | 10 |
| Paint layer (outermost layer) | | | | |
| Composition | P6 | P7 | P4 | P4 |
| Indentation depth (nm) | 1500 | — | — | — |
| Thickness (μm) | 10 | 10 | 10 | 15 |
| CAw (degrees) | 72 | 71 | 82 | 82 |
| Sb (mm) | 2.8 | 2.8 | 2.8 | 2.8 |
| W#1 flight performance | | | | |
| Vd (m/s) | 73.0 | 73.0 | 73.0 | 73.0 |
| Vw (m/s) | 72.6 | 72.5 | 73.0 | 73.0 |
| FTd (m) | 247 | 247 | 247 | 247 |
| FTw (m) | 229 | 228 | 235 | 235 |
| FRd (m) | 84 | 84 | 84 | 84 |
| FRw (m) | 75 | 74 | 78.5 | 78.5 |
| Vd − Vw (m/s) | 0.4 | 0.5 | 0 | 0 |
| FTd − FTw (m) | 18 | 19 | 12 | 12 |
| FRd − FRw (m) | 9 | 10 | 5.5 | 5.5 |

As shown in Tables 4 and 5, with the golf ball of each Example, a flight distance equivalent to that of the golf ball of each Comparative Example was achieved in a dry state. In addition, with the golf ball of each Example, decreases in a ball speed and a flight distance in a wet state are smaller than those with the ball of each Comparative Example. From the results of evaluation, advantages of the present invention are clear.

The paint layer described above is applicable to a one-piece ball, a two-piece ball, a four-piece ball, a five-piece ball, a six-piece ball, a thread-wound ball, and the like in addition to a three-piece ball. The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball comprising a main body and a paint layer positioned outside the main body, wherein the paint layer is formed from a resin composition including a polyurethane as a base resin, wherein the polyurethane is obtained by mixing a base material and a curing agent, and wherein a mole ratio (NCO group/OH group) of an isocyanate group (NCO group) of the curing agent to a hydroxyl group (OH group) of the base material is not less than 0.1 and not greater than 2.0, an indentation depth, measured when the paint layer in a cross-section along a plane passing through a central point of the golf ball is pressed with a force of 30 mgf in a direction perpendicular to the cross-section, is not less than 200 nm and not greater than 3000 nm, the resin composition includes a silicone compound and/or a fluorine compound, an outer surface of the paint layer forms a surface of the golf ball, and a contact angle CAw with respect to water measured on the surface of the golf ball is not less than 70 degrees.

2. The golf ball according to claim 1, wherein the contact angle CAw is not less than 75 degrees.

3. The golf ball according to claim 1, wherein the contact angle CAw is not less than 80 degrees.

4. The golf ball according to claim 1, wherein the contact angle CAw is not greater than 120 degrees.

5. The golf ball according to claim 1, wherein the golf ball has no surface on which the contact angle CAw is less than 70 degrees.

6. The golf ball according to claim 1, wherein the paint layer has a thickness of not less than 5 μm and not greater than 50 μm.

7. The golf ball according to claim 1, wherein the silicone compound is dimethyl silicone.

8. The golf ball according to claim 1, wherein the fluorine compound is polytetrafluoroethylene.

9. The golf ball according to claim 1, wherein an amount of the silicone compound and/or the fluorine compound in the resin composition including the polyurethane as the base resin, on the solid content basis, is not less than 0.05% by weight and not greater than 20% by weight.

10. The golf ball according to claim 1, wherein the polyurethane is obtained by mixing a base material and a curing agent, and a ratio (AB) of a weight A of the base material and a weight B of the curing agent is not less than 2/1 and not greater than 20/1.

11. A golf ball comprising a main body and a paint layer positioned outside the main body, wherein an outer surface of the paint layer forms a surface of the golf ball, a contact angle CAw with respect to water measured on the surface of the golf ball is not less than 70 degrees, and an indentation depth, measured when the paint layer in a cross-section along a plane passing through a central point of the golf ball is pressed with a force of 30 mgf in a direction perpendicular to the cross-section, is not less than 200 nm and not greater than 3000 nm.

12. A golf ball comprising a main body and a paint layer positioned outside the main body, wherein the paint layer is formed from a resin composition including a silicone compound and/or a fluorine compound as a base resin, and the resin composition includes no polyurethane, an outer surface of the paint layer forms a surface of the golf ball, a contact angle CAw with respect to water measured on the surface of the golf ball is not less than 70 degrees, and an indentation depth, measured when the paint layer in a cross-section along a plane passing through a central point of the golf ball is pressed with a force of 30 mgf in a direction perpendicular to the cross-section, is not less than 200 nm and not greater than 3000 nm.

13. A golf ball comprising a main body and a paint layer positioned outside the main body, wherein the paint layer is formed from a resin composition including a polyurethane as a base resin, wherein the polyurethane is obtained by mixing a base material and a curing agent such that a ratio (AB) of a weight A of the base material and a weight B of the curing agent is not less than 2/1 and not greater than 20/1, and wherein a mole ratio (NCO group/OH group) of an isocyanate group (NCO group) of the curing agent to a hydroxyl group (OH group) of the base material is not less than 0.1 and not greater than 2.0, the resin composition includes a silicone compound and/or a fluorine compound, wherein an amount of the silicone compound and/or the fluorine compound in the resin composition including the polyurethane as the base resin, on the solid content basis, is not less than 0.05% by weight and not greater than 20% by weight an outer surface of the paint layer forms a surface of the golf ball, and a contact angle CAw with respect to water measured on the surface of the golf ball is not less than 70 degrees.

* * * * *